US006891321B2

(12) United States Patent
Sanders et al.

(10) Patent No.: US 6,891,321 B2
(45) Date of Patent: May 10, 2005

(54) OIL-FREE ELECTRON SOURCE HAVING CATHODE AND ANODE MEMBERS ADJUSTABLE WITH FIVE DEGREES OF FREEDOM

(75) Inventors: Thomas Clarke Sanders, Palo Alto, CA (US); Roy Edward Rand, Palo Alto, CA (US); Khem Garewal, San Ramon, CA (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 0 days.

(21) Appl. No.: 10/306,282

(22) Filed: Nov. 27, 2002

(65) Prior Publication Data

US 2004/0090166 A1 May 13, 2004

Related U.S. Application Data

(60) Provisional application No. 60/426,088, filed on Nov. 12, 2002, and provisional application No. 60/425,942, filed on Nov. 12, 2002.

(51) Int. Cl.[7] ..... H01J 29/46

(52) U.S. Cl. ..... 313/448; 313/441; 313/446; 313/447; 313/452; 313/459; 313/458; 313/460

(58) Field of Search ..... 313/448, 441, 313/446, 447, 449, 451, 452, 456, 459, 458, 460; 378/119, 121

(56) References Cited

U.S. PATENT DOCUMENTS

| | | | |
|---|---|---|---|
| 4,621,213 | A | 11/1986 | Rand |
| 5,105,456 | A | 4/1992 | Rand et al. |
| 5,289,519 | A | 2/1994 | Rand |
| 5,719,914 | A | 2/1998 | Rand et al. |
| 6,208,711 | B1 | 3/2001 | Rand et al. |
| 2002/0003395 | A1 | 1/2002 | Burkhardt et al. |

OTHER PUBLICATIONS

Etec MEBES 5500 brochure.

*Primary Examiner*—Nimeshkumar D. Patel
*Assistant Examiner*—Sharlene Leurig
(74) *Attorney, Agent, or Firm*—McAndrews, Held & Malloy, Ltd.; Peter J. Vogel; Michael A. Dellapenna

(57) ABSTRACT

An electron source includes a vacuum chamber within which a vacuum is maintained by a vacuum pump. An insulated receptacle is mounted within the vacuum chamber and has a receptacle mounting flange. The receptacle mounting flange is used to establish a coordinate system having an electron beam axis and a lateral plane, wherein the lateral plane is transverse to the electron beam axis. An adapter is mounted to the receptacle and is adjustable in five degrees of freedom with respect to the coordinate system. A cathode and focus electrode are adjustable in at least four degrees of freedom and are pre-aligned with respect to one another prior to being installed on the adapter. An anode is mounted in the vacuum chamber and is aligned at a predetermined distance from the cathode with respect to the coordinate system.

9 Claims, 11 Drawing Sheets

OIL-FREE ELECTRON SOURCE HAVING CATHODE AND ANODE MEMBERS ADJUSTABLE WITH FIVE DEGREES OF FREEDOM

RELATED APPLICATIONS

This application is related to, and claims priority from, Provisional Applications filed Nov. 12, 2002, provisional application No. 60/426,088 titled "OIL-FREE ELECTRON SOURCE FOR AN EBT SCANNER", and provisional application No. 60/425,942 titled "OIL-FREE ELECTRON SOURCE HAVING CATHODE AND ANODE MEMBERS ADJUSTABLE WITH FIVE DEGREES OF FREEDOM", the complete subject matter of which are incorporated herein by reference in its entirety. This application is also related to Provisional Application No. 60/426,088, filed on the same date as the present application, titled "OIL-FREE ELECTRON SOURCE FOR AN EBT SCANNER", the complete subject matter of which is incorporated herein by reference in its entirety.

BACKGROUND OF THE INVENTION

The present invention generally relates to electron beam tomography (EBT) scanners used for diagnostic imaging. In particular, the present invention relates to electron source assemblies used to create an electron beam in an EBT scanner.

Diagnostic imaging systems encompass a variety of imaging modalities, such as x-ray systems, computerized tomography (CT) systems, ultrasound systems, electron beam tomography (EBT) systems, magnetic resonance (MR) systems, and the like. Diagnostic imaging systems generate images of an object, such as a patient, through exposure to an energy source, such as x-rays passing through the patient, for example. The generated images may be used for many purposes. For instance, internal defects in an object may be detected. Additionally, changes in internal structure or alignment may be determined. Fluid flow within an object may also be represented. Furthermore, the image may show the presence or absence of items in an object. The information gained from diagnostic imaging has applications in many fields, including medicine and manufacturing.

EBT systems utilize a high energy beam of electrons to strike a target and produce x-rays for irradiating an object to be imaged. The point where the electrons strike the target is called the "beam spot". The electron beam may be "tuned" and/or corrected to minimize error and more accurately produce a beam spot.

As described in U.S. Pat. Nos. 5,719,914 and 6,208,711, which are incorporated herein by reference in their entirety, an electron beam is produced by an electron source at the upstream end of a vacuum housing chamber. A large negative potential (e.g., −140 kV) on the cathode of the electron source accelerates the electron beam downstream along an electron beam axis. Further downstream, a beam optical system that includes magnetic focusing, quadrupole, and deflection coils focuses and deflects the beam to scan along an x-ray producing target.

Under normal use, the cathode has a lifetime of approximately 18 months and is the most likely part within an electron source to fail. Unfortunately, the cathode may also be destroyed by accidents, over-voltage conditions, or loss of vacuum, for example. Upon failure, the electron source assembly must be removed and returned to a factory facility for refurbishment and/or repair. Previous electron sources have been constructed such that the electron source housing must be cut open, such as at one or more ceramic-to-metal seals. The cathode is replaced within the assembly and then aligned with regard to the electron beam axis. After the cathode is aligned, the electron source housing ceramic-to-metal seals are replaced. Therefore, replacing the cathode has required time consuming and expensive reassembly and realignment.

Additionally, high voltage connections in previous electron sources have utilized an oil tank, which contains the high voltage receptacle. The removal and addition of the oil added further complexity and time to the repair and refurbishment process.

Thus, a need exists for a method and apparatus for providing an electron source which is oil-free and can be easily disassembled and reassembled, with a cathode which is easy to replace and align that addresses the problems noted above and previously experienced.

BRIEF SUMMARY OF THE INVENTION

In accordance with at least one embodiment, an electron source is provided. The electron source includes a vacuum chamber within which a vacuum is maintained. An electron beam axis extends through the vacuum chamber. An insulated receptacle is mounted within the vacuum and has a receptacle mounting flange with a surface establishing a lateral plane perpendicular to the electron beam axis. An anode and cathode are provided within the vacuum chamber and are aligned with one another. An adapter is adjustable in five degrees of freedom with respect to the electron beam axis and lateral plane. The adapter retains the cathode at a predetermined orientation and position with respect to the electron beam axis and lateral plane.

In accordance with at least one embodiment, a method for aligning an electron source is provided. The method includes mounting an insulated receptacle having a receptacle mounting flange with a surface and an outside diameter within a vacuum chamber. An electron beam axis is established based on the outside diameter and extends through the receptacle. A lateral plane is established based on the surface and is transverse with respect to the electron beam axis. One end of an adapter is mounted to the receptacle. A cathode-focus electrode assembly is assembled and includes a cathode with an emitter surface and a focus electrode with an outer edge. The cathode and focus electrode are pre-adjusted in at least four degrees of freedom with respect to the outer edge and the emitter surface. The cathode-focus electrode assembly is mounted to the adapter. An anode is mounted to the vacuum chamber and is aligned with the cathode along the electron beam axis.

In accordance with at least one embodiment, a method for assembling and aligning an electron source is provided. The method includes mounting an insulated receptacle on a rotary indexer. At least one height gage and at least one dial indicator are used together with the rotary indexer. The receptacle has a mounting flange with an outside diameter and a surface. An electron beam axis is established based on the outside diameter, and a lateral plane is established based on the surface, the lateral plane being transverse with respect to the electron beam axis. An adapter is mounted to the receptacle. The adapter is adjusted axially with respect to the electron beam axis to achieve a predetermined distance between the surface and an adapter top edge. The adapter is adjusted within the lateral plane with respect to the electron beam axis, and is adjusted angularly with respect to the lateral plane.

Figure 1:
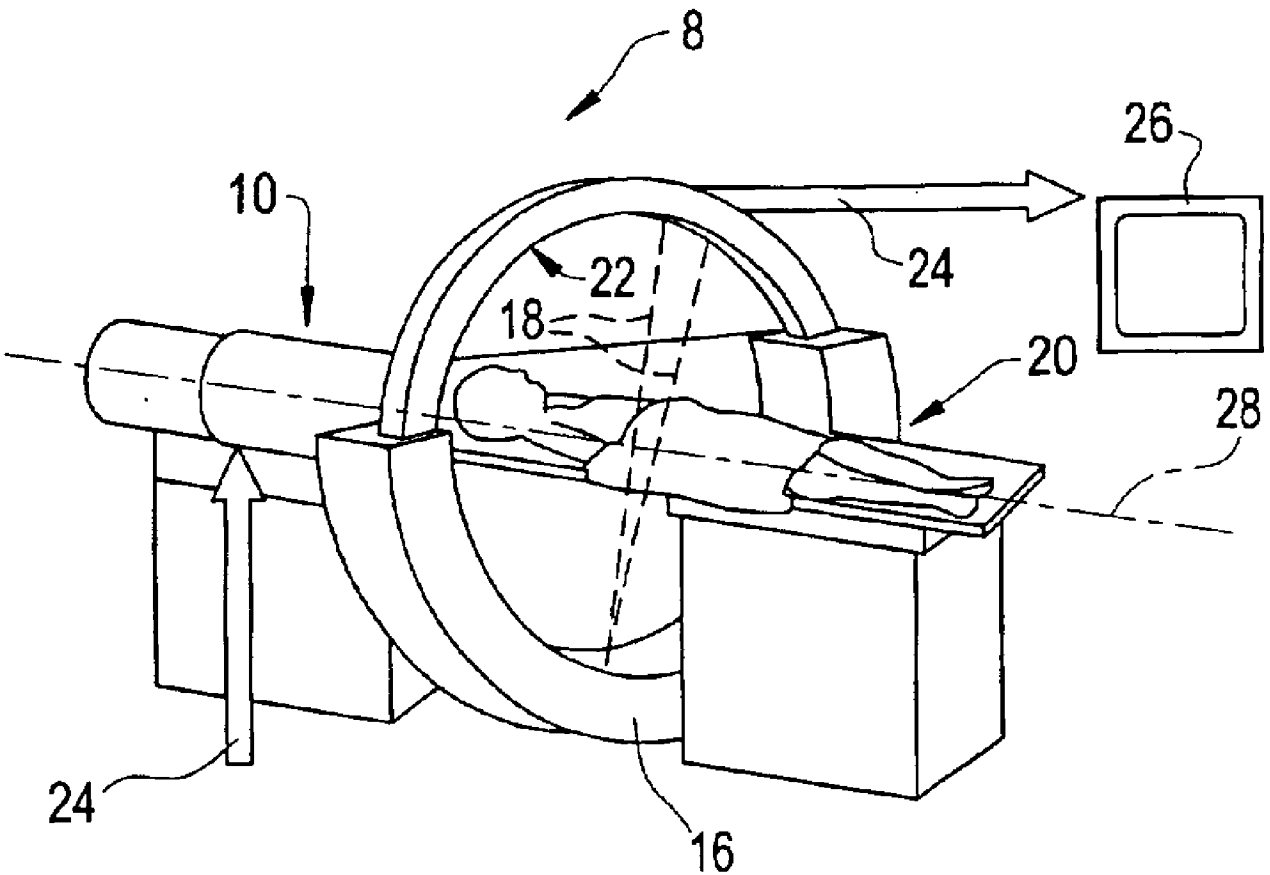
FIG. 1 illustrates an electron beam tomography (EBT) scanner system using an electron source formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

The following detailed description references an Electron Beam Tomography (EBT) imaging system. It is understood that the present invention may be used with other imaging systems and other electron beam systems.

Figure 2:
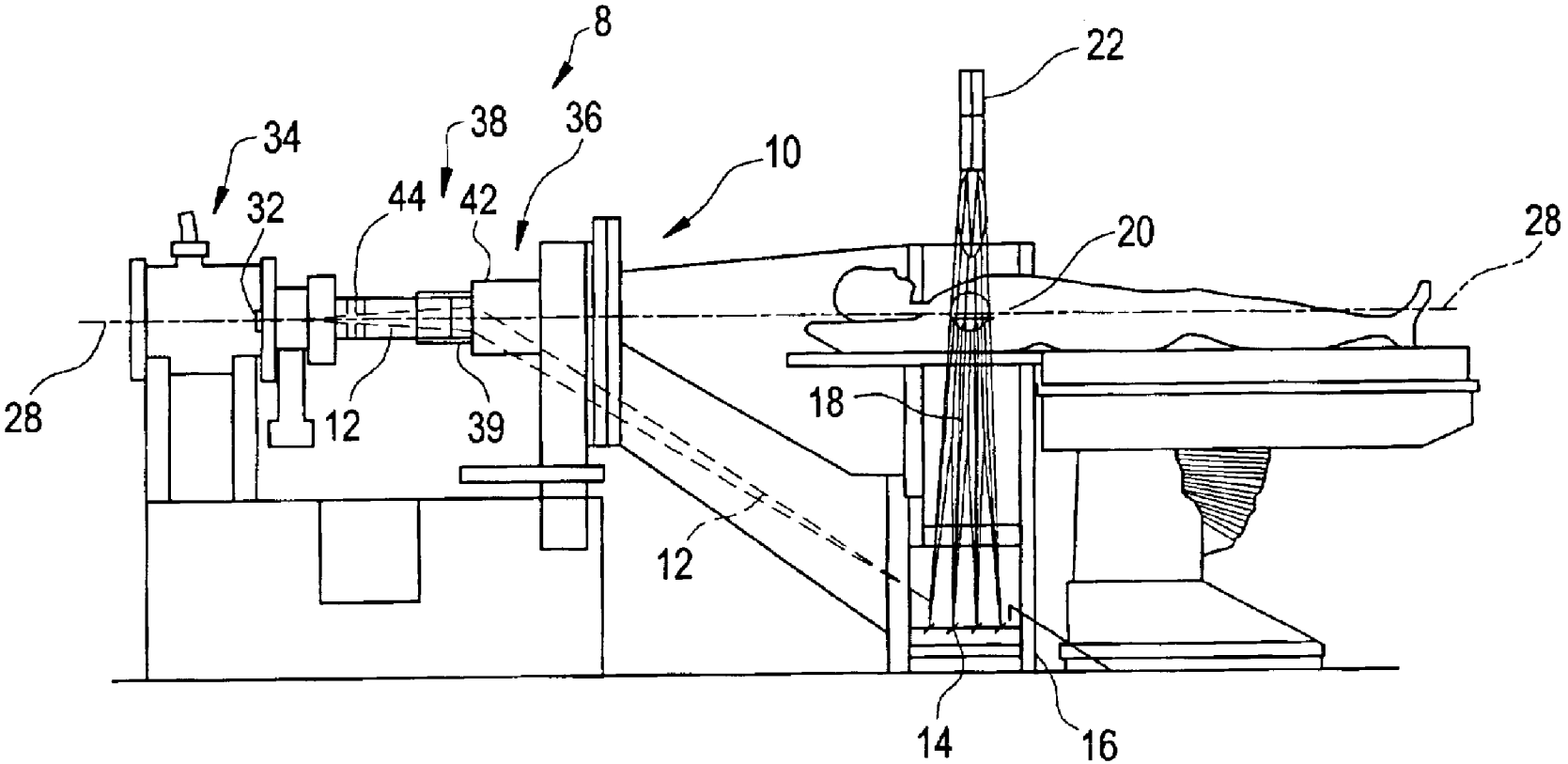
FIG. 2 is a more detailed illustration of the EBT scanner system of FIG. 1 showing how an electron beam traverses through the system.

FIG. 1 and FIG. 2 illustrate a generalized electron beam tomography (EBT) scanner, designated as system 8. The system 8 will be discussed with reference to both FIGS. 1 and 2 to provide an understanding of the operation of an EBT scanner. System 8 includes a vacuum chamber housing 10 in which an electron beam 12 is generated at the cathode of an electron source 32 located in upstream region 34, in response to perhaps a −140 kV high voltage. The electron beam 12 is then caused by optical system 38, including magnetic lens 39 and coils 42, to scan at least one circular target 14 located within a front lower portion 16.

When scanned by the focused electron beam 12, the target 14 emits a moving fan-like beam of X-rays 18. X-rays 18 then pass through a region of a subject 20 (e.g. a patient or other object) and register upon a detector array 22 located diametrically opposite. The detector array outputs data to a computer system (indicated by arrows 24 in FIG. 1) that processes and records the data, producing an image of a slice of the subject on a video monitor 26. As indicated by the second arrow 24, the computer system also controls the system 8 and the electron beam 12 production therein.

Gases in housing 10 produce positive ions in the presence of the electron beam 12. Positive ions are beneficial in the downstream, self-focusing region 36, but should be removed (or at least be suitably controlled) in the upstream, self-expanding de-focusing region 34.

Beam optical system 38 is mounted outside and within housing 10 and includes magnetic lens 39, deflecting coils and quadrupole coils (collectively coils 42), and an electrode assembly 44. Magnetic lens 39 and coils 42 contribute a focusing effect to help shape the final beam spot as it scans one of the targets 14. Electrode assembly 44 controls positive ions in the upstream region.

Electrode assembly 44 is mounted within housing 10 between the electron source 32 and the beam optical system 38 such that the electron beam 12 passes axially through assembly 44 along the Z-axis 28. Ideally, the Z-axis 28 is coaxial with the electron beam 12 upstream from the beam optics assembly 38 within chamber 10. Z-axis 28 also represents the longitudinal axis of chamber 10, and the axis of symmetry for the electrode assembly 44 and the beam optics assembly 38.

Figure 3:
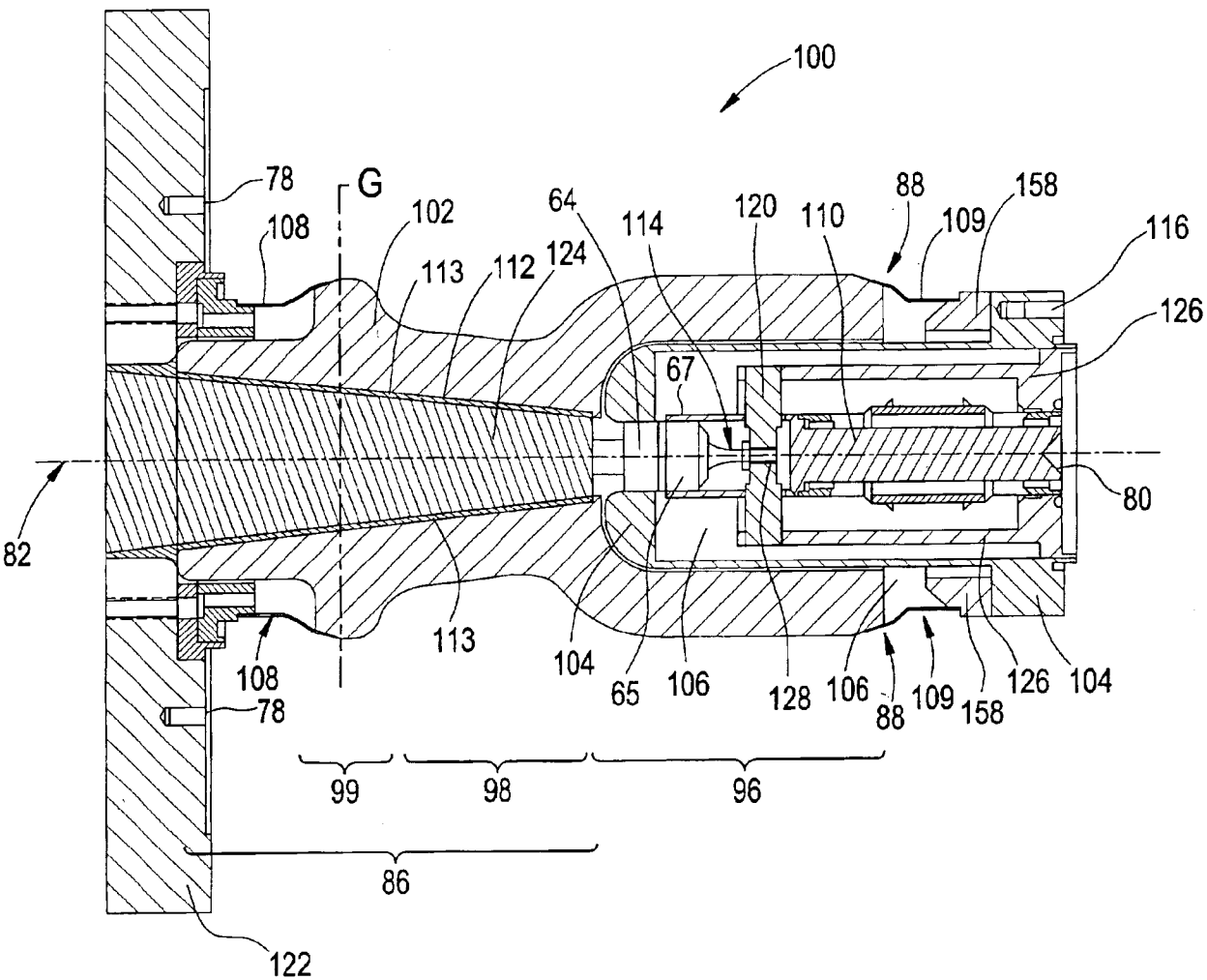
FIG. 3 illustrates a receptacle assembly in accordance with an embodiment of the present invention.

FIG. 3 illustrates a cross-sectional view of a receptacle assembly 100. The receptacle assembly 100 includes a receptacle mounting flange 122, a cathode mounting flange 158 and an insulated receptacle 102 which is cylindrical with a hollow core. The insulated receptacle 102 may be comprised of a ceramic material or other rigid insulating material. One portion 86 of the hollow core forms a cone 112, while portion 96 of the hollow core is substantially cup shaped. The cone 112 of the insulated receptacle 102 extends from the receptacle mounting flange 122 to the cup shaped portion 96. It should be understood that many items illustrated in FIGS. 3–10 are rotationally symmetric about an electron beam axis 82, with the exception of items such as screws, connectors, and the like.

The insulated receptacle 102 includes an intermediate tapered portion 98 and is formed with a substantially uniform thickness, while the base portion 99 is formed with a larger thickness and is brazed to the receptacle mounting flange 122 with a circular ceramic-to-metal adapter 108. The outer end 88 of the insulated receptacle 102 is brazed to the cathode mounting flange 158 with a second ceramic-to-metal adapter 109. The uniform thickness helps to prevent the insulated receptacle 102 from cracking when brazing the ceramic-to-metal adapters 108 and 109.

The receptacle assembly 100 includes an electrically common shell 104 inserted into the open cup portion 96 of insulated receptacle 102. The electrically common shell 104 is welded to the cathode mounting flange 158. A sleeve 126 is joined to the electrically common shell 104. A cross bar 120 with a threaded hole 128 is held by sleeve 126. The shell 104 is concentrically arranged with, and surrounds, rod 110. A gap 106 separates the rod 110 from the sleeve 126 and the sleeve 126 from the shell 104. The gap 106 is filled with ambient air.

A voltage source is provided to a high voltage connector 124 such as a −140 kV source from a voltage generator (not shown). The high voltage connector 124 is inserted into the cone 112. Dielectric grease 113 is utilized to create an air-free interface between the high voltage connector 124 and the cone 112.

One end of an electrical pin 114 interfaces with radial contacts 64 of high voltage connector 124. The other end of the electrical pin 114 is inserted through the threaded hole 128 in the cross bar 120 and electrically communicates with the rod 110. The rod 110 extends through the sleeve 126 and beyond the open cup portion 96 of the insulated receptacle 102. The rod 110 may be comprised of copper or other conductive material. The rod 110 has a curved recess 80 at one end and conveys heater power to a cathode-focus electrode assembly 130 (FIG. 4).

Figure 4:
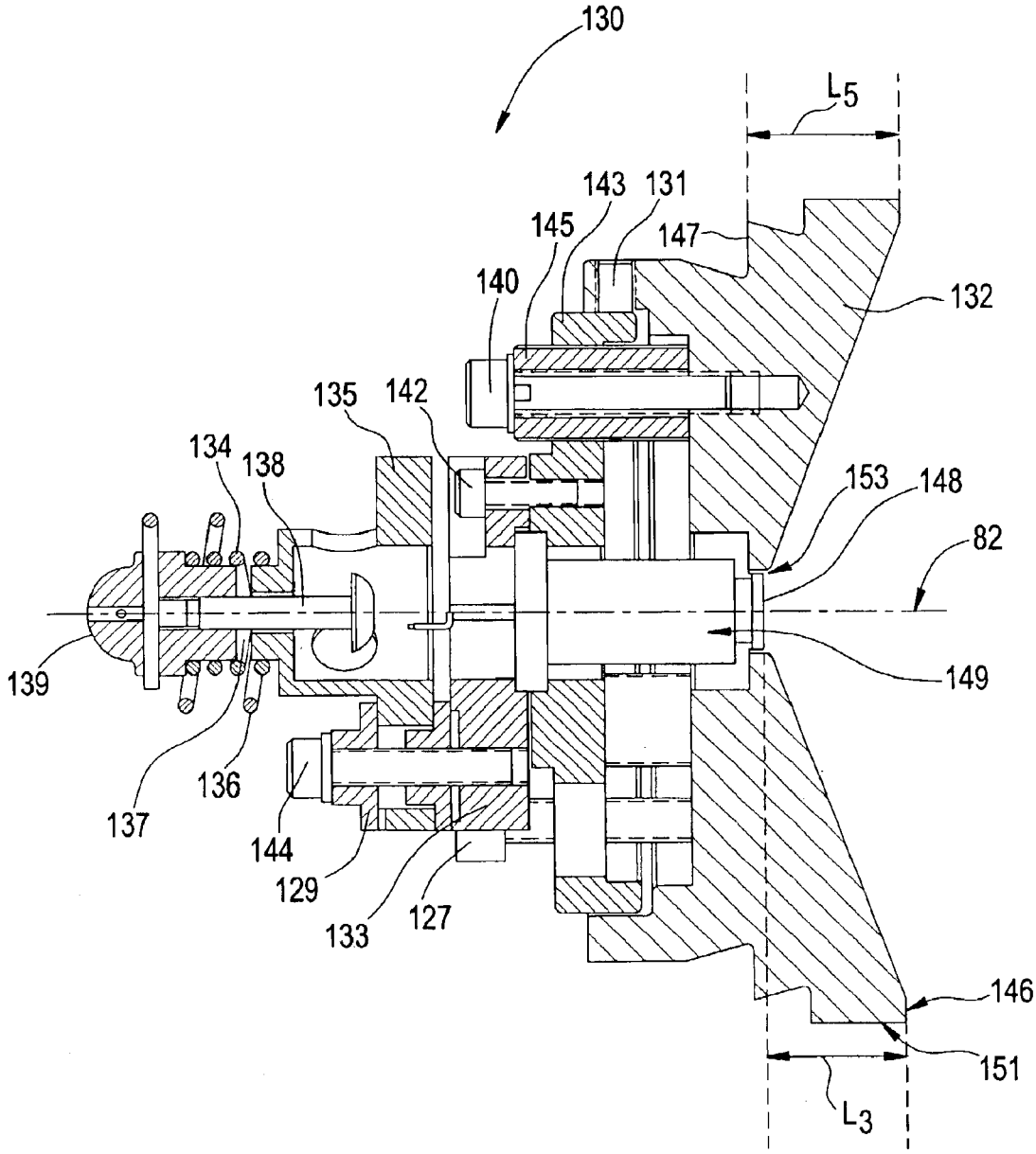
FIG. 4 illustrates a cathode focus assembly in accordance with an embodiment of the present invention.
Figure 6:
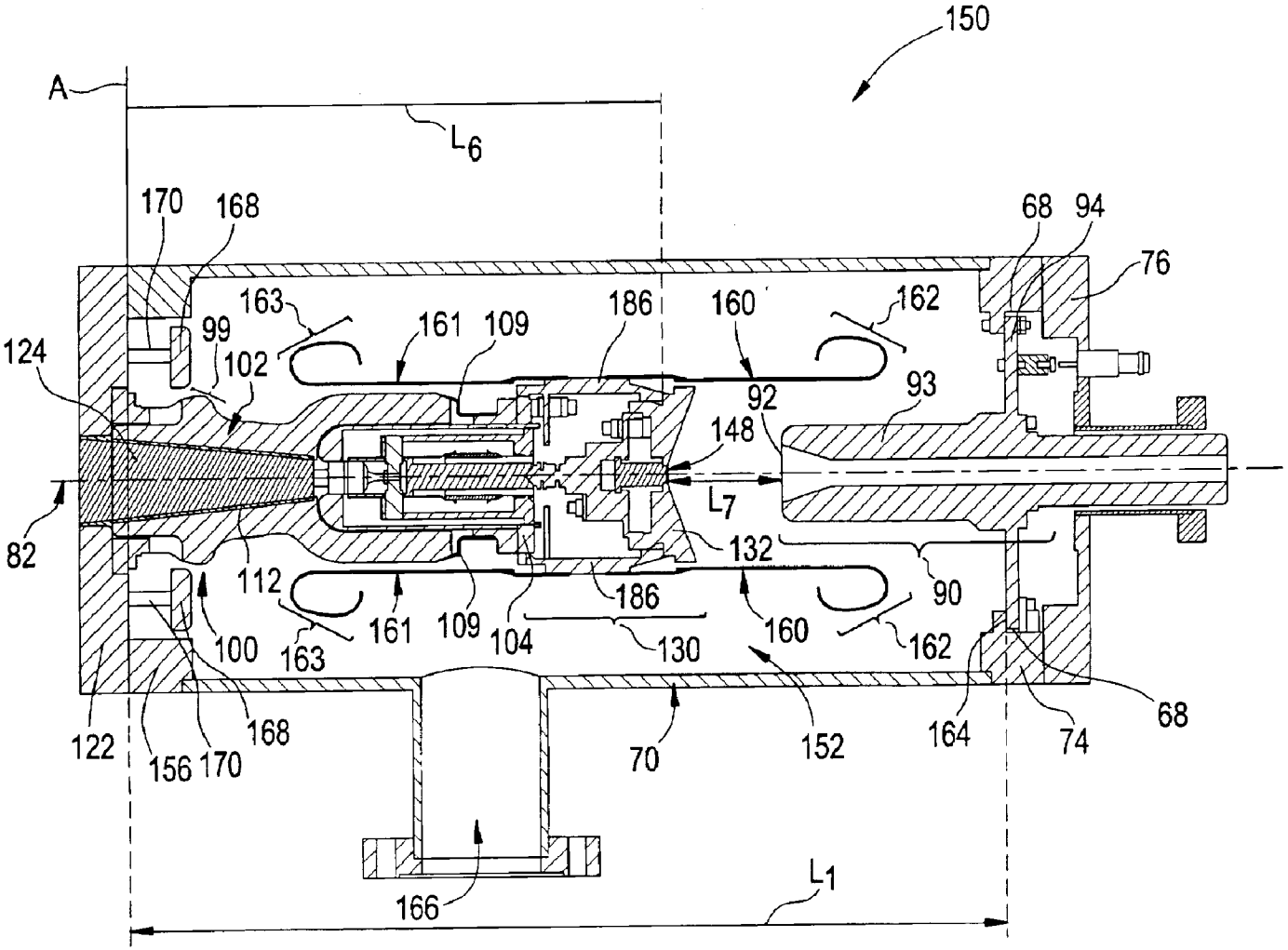
FIG. 6 illustrates an electron source assembly in accordance with an embodiment of the present invention.

FIG. 4 illustrates a cathode-focus electrode assembly 130. The cathode-focus electrode assembly 130 includes a cathode 149 having an emitter surface 148 and a focus electrode 132. The cathode 149 is prealigned with respect to the focus electrode 132 prior to installing the cathode-focus electrode assembly 130 in electron source assembly 150 (FIG. 6).

Adjustable members, such as levelers, may be used to prealign the cathode 149 and focus electrode 132. A leveler is a hollow, cylindrical fastener having threads on the outside surface. Three levelers 145 (one is shown) are arranged equidistant around the cathode 149 and are used to adjust the angular alignment of the outer edge 146 of the focus electrode 132 to be parallel to the emitter surface 148, such as by adjusting the levelers 145 with unequal amounts of rotation. The levelers 145 are also used to adjust the axial alignment by moving the focus electrode 132 to achieve a predefined distance $L_3$ between the emitter surface 148 and the outer edge 146, such as by adjusting the levelers 145 with equal amounts of rotation. A screw 140 is screwed into the hollow interior of each leveler 145 and is tightened after the adjustment is complete. Three jack screws 127 are screwed into the cathode mount 143 and push on the back of the focus electrode 132, providing a secondary locking mechanism to keep the cathode 149 and focus electrode 132 in proper alignment.

The position of the electron beam axis 82, as illustrated in FIG. 4, is defined with respect to a side edge 153 of the emitter. Four set screws 131 (one is shown) may be used to adjust the cathode 149 laterally (in the X-Y plane) with respect to the side edge 151.

Prealigning the cathode-focus electrode assembly 130 is advantageous as the cathode 149 degrades with use and must be replaced periodically. Therefore, having the ability to replace a subassembly containing the cathode 149, such as the cathode-focus electrode assembly 130, with a prealigned subassembly simplifies and reduces the time required for the alignment, replacement and/or repair of the cathode 149 and cathode-focus electrode assembly 130.

In FIG. 4, a cathode retainer 133 is attached to the cathode mount 143 with three screws 142. A cathode contact support 135 is attached to the cathode retainer 133 with three screws 144. The screws 144 are electrically isolated by way of ceramic insulators 129. A cathode contact 139 is separated from the cathode contact support 135 by a gap 137 and held in position by screw 138. A spring 134 is installed between the cathode contact 139 and the cathode contact support 135 and provides the force to seat the cathode contact 139 in the curved recess 80 of the rod 110 (FIG. 3). A copper electrical conductor 136, in the form of a helix, provides a low resistance electrical connection and conveys cathode heater voltage between the contact support 135 and the cathode contact 139.

Figure 5:
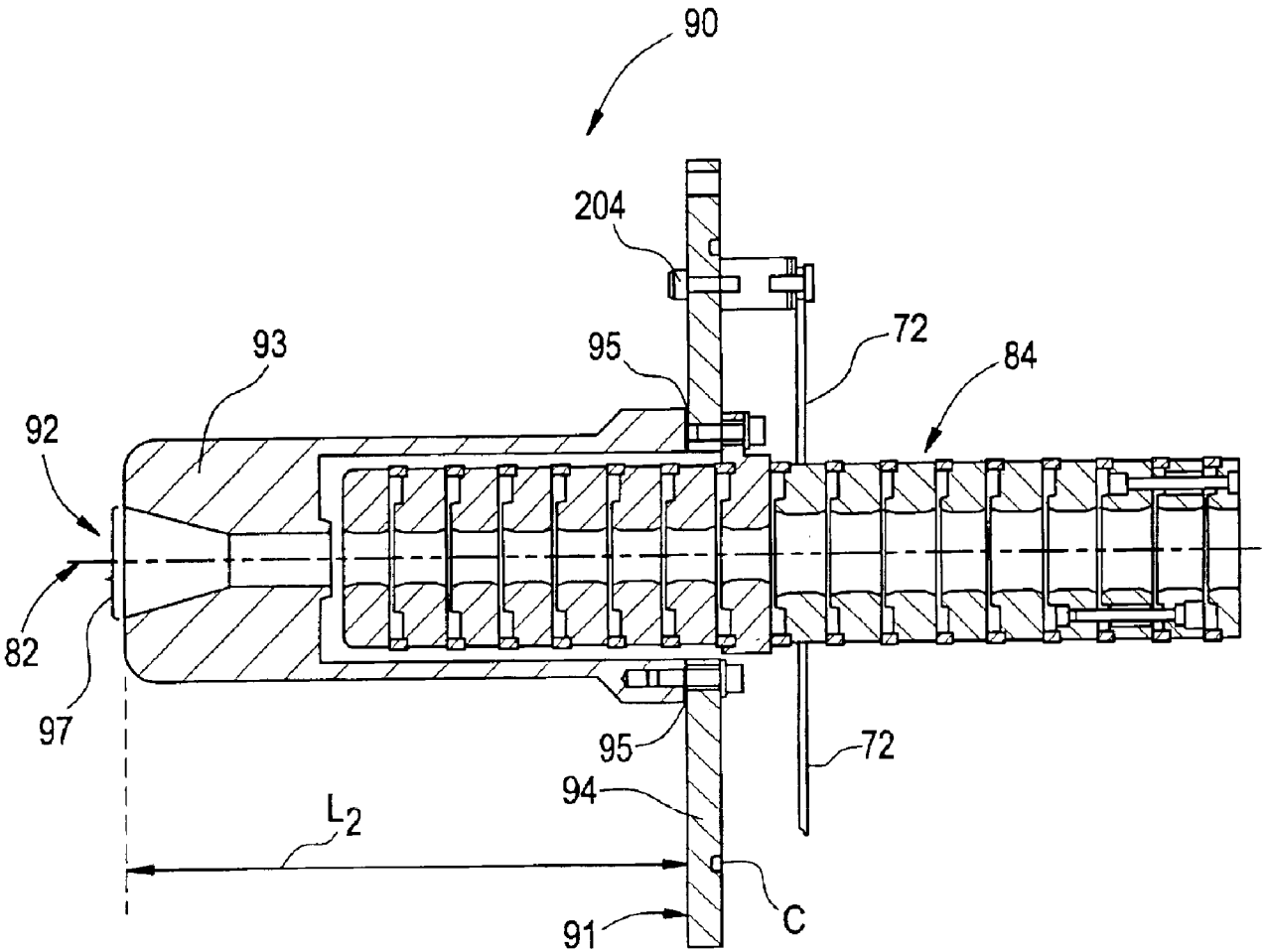
FIG. 5 illustrates an anode assembly in accordance with an embodiment of the present invention.

FIG. 5 illustrates an anode assembly 90. The anode assembly 90 includes an anode body 93 and a mounting plate 94. The anode assembly 90 may also include an ion clearing electrode (ICE) 84, which removes positive ions from the electron beam 12 (FIG. 2). The anode body 93 has an anode front surface 92 with a hole 97 through which the electron beam 12 passes. The mounting plate 94 is manufactured to a predefined tolerance along a surface 91, which is perpendicular to the electron beam axis 82.

FIG. 6 illustrates an electron source assembly 150. The electron source assembly 150 includes the receptacle assembly 100, the cathode-focus electrode assembly 130 and the anode assembly 90 as previously illustrated in FIGS. 3–5, respectively, installed within a vacuum chamber 152. The cathode-focus electrode assembly 130 is mounted from one end of the vacuum chamber 152 and the anode assembly 90 is mounted from the opposite end of the vacuum chamber 152.

The vacuum chamber 152 is comprised of a tube 70 attached to a flange 156 at one end. The flange 156 is attached to the mounting flange 122 of the receptacle assembly 100. The other end of the tube 70 is attached to a flange 74 which incorporates a mounting surface 164. The tube 70 also includes a small tube mounted flange 166 for attachment of a vacuum pump (not shown). The vacuum pump attached to flange 166 is used to maintain a vacuum in the vacuum chamber 152. The insulated receptacle 102 is secured to the receptacle mounting flange 122 and is suspended within the vacuum chamber 152. The cathode-focus electrode assembly 130 is attached to an adapter 186 which is attached to the end of the receptacle assembly 100. The anode assembly 90 is mounted in the vacuum chamber 152 by attaching the mounting plate 94 to the mounting surface 164 of flange 74. Both the anode front surface 92 and the emitter surface 148 are exposed to the vacuum within the chamber 152.

Upper and lower field electrodes 160 and 161 are mounted at either end of the adapter 186. Field electrodes 160 and 161 are tube shaped and encircle the adapter 186. Field electrodes 160 and 161 include flared ends 162 and 163, respectively. Field electrode 160 extends beyond the adapter 186 and encircles, but does not contact, a portion of the anode assembly 90. The field electrode 161 extends beyond the electrical pin 114 towards the receptacle mounting flange 122.

Several voltages are supplied to the electron source assembly 150 by a power supply (not shown) via high voltage connector 124. The high voltage connector 124 is inserted into cone 112 and radially contacts the electrical pin 114. Radial contact 64 laterally interfaces with electrically common shell 104 and radial contact 65 laterally interfaces with a surrounding cylinder 67. The high voltage is supplied to a high voltage assembly, which includes the parts mounted on the vacuum end of the insulated receptacle 102, such as the adapter 186 attached to the receptacle assembly 100, the cathode-focus electrode assembly 130 mounted inside the adapter 186, and the two field electrodes 160 and 161 attached to the adapter 186. The field electrodes 160 and 161 reduce the electric field between the high voltage assembly and the surrounding grounded metallic surfaces, such as the inside of the tube 70 and the flanges 156 and 74. The field electrodes 160 and 161 reduce the electric field by providing a larger radius of curvature at the extreme ends of the high voltage assembly, such as at the flared ends 162 and 163. In addition, a ring-shaped ground electrode 168 is attached to the receptacle mounting flange 122 and acts to reduce the electric field at the edge G of ceramic to metal adapter 108 (FIG. 3) to a value which will not cause breakdown of the high voltage. If the electric field is not reduced, high voltage breakdown between the high voltage assembly and edge G may occur.

The cathode-focus electrode assembly 130 is maintained at a potential of −140 kV and receives a cathode heater power (up to 10 Vac at 3 amps referenced to the −140 kV). The cathode heater (not shown) is contained within the cathode 149 and elevates the emitter surface 148 to 1100 degrees centigrade to produce the required number of electrons. The potential of −140 kV produces an electric field between the cathode 149 and the anode body 93. The focus electrode 132 shapes the electric field so that electrons from the cathode 149 are formed into a uniform laminar beam, such as electron beam 12 of FIG. 2, which is accelerated toward, and passes through, the hole 97 in the anode front surface 92.

The correct operation of the electron source assembly 150 depends, among other things, on the precise setting of a predefined distance $L_7$ from the cathode emitter 148 to the anode front surface 92. The predefined distance $L_7$ is achieved by measuring fixed dimensions and using the fixed dimensions to calculate the position of parts which may be moved axially along the Z axis, i.e. along the electron beam axis 82. For example, the distance $L_7$ may be increased or decreased by adding or removing one or more shims 95 (FIG. 5) between mounting plate 94 and the anode body 93. The current of the electron beam 12 is increased by decreasing the distance $L_7$.

A distance $L_1$ is measured from the edge of the flange 156 to the mounting surface 164 of flange 74. A distance $L_2$ (FIG. 5) of the anode assembly 90 is measured from the anode front surface 92 to the surface 91 of the mounting plate 94. The axial position of the anode front surface 92 along the electron beam axis 82 is determined from measurements $L_1$ and $L_2$. A distance $L_5$ (FIG. 4) is measured from the outer edge 146 of the focus electrode 132 to focus electrode mounting surface 147. The cathode emitter 148 depth setting $L_3$ is measured from the emitter surface 148 to the outer edge 146 of the focus electrode 132. The desired distance $L_6$ (FIG. 6), the distance from the top of receptacle mounting flange 122 (datum A) to the top of the adapter 186, may now be calculated. The position of the adapter 186 along the electron beam axis 82 is set to the calculated value of $L_6$. After installing the cathode-focus electrode assembly 130, distance $L_6$ is measured and compared to the calculated value.

Figure 11:
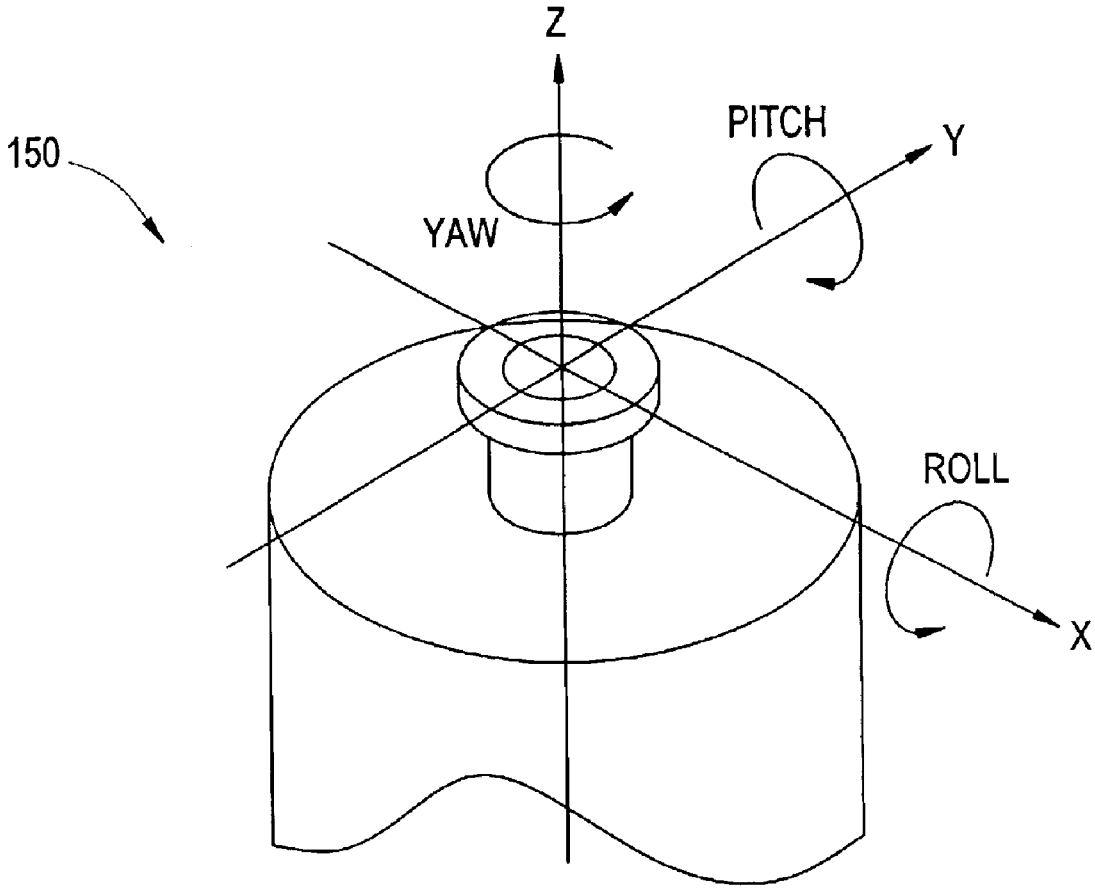
FIG. 11 illustrates a conceptual view of the electron source assembly with X, Y, Z, yaw, pitch and roll indicated.

FIG. 11 illustrates a conceptual drawing of the electron source assembly 150 with X, Y, and Z axis indicated. The Z axis may also be the electron beam axis 82. Additionally, yaw, pitch and roll are illustrated. Yaw is rotation around the vertical axis Z, or electron beam axis 82. Pitch is rotation around the side-to-side axis Y, and roll is rotation around the front-to-back axis X. By being able to adjust the adapter 186 in five different degrees of freedom with respect to the X-Y plane and the Z axis, the desired alignment can be more quickly achieved. Alignment of the electron source assembly 150 is established by adjusting parts or assemblies axially (Z-axis), laterally (X-Y plane) and angularly (roll and pitch), and measuring with respect to datums A and B of the receptacle mounting flange 122 and the electron beam axis 82, as discussed further below.

Figure 7:
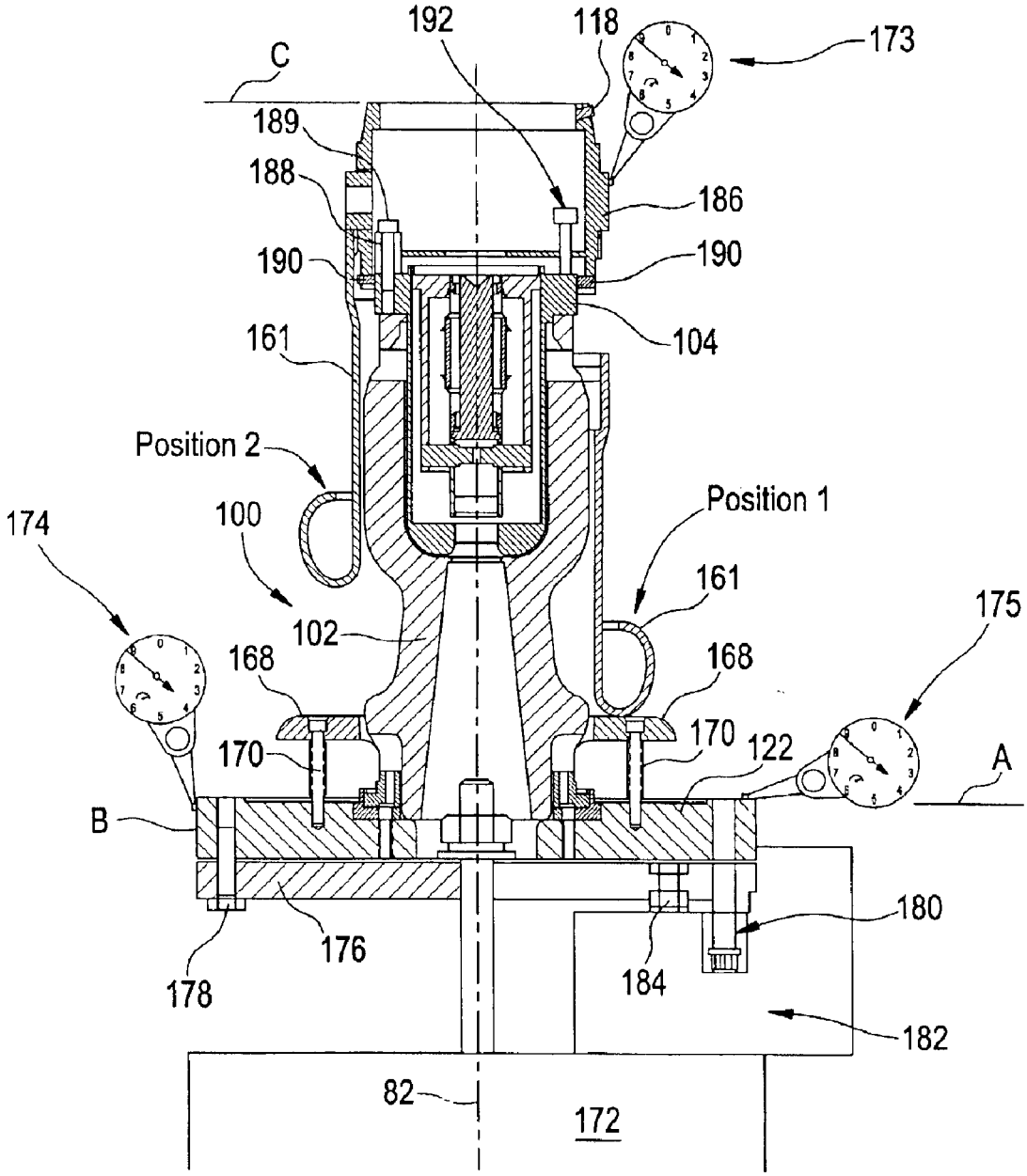
FIG. 7 illustrates the receptacle assembly and adapter mounted to a rotary indexer in accordance with an embodiment of the present invention.

FIG. 7 illustrates the receptacle assembly 100 mounted to a rotary indexer 172. As discussed below, the electron source assembly 150 of FIG. 6 may be assembled and aligned with the use of the rotary table or indexer 172, such as the Super Accu-dex 550-008, manufactured by Yuasa. It should be understood that the embodiment disclosed is not limited to the use of the aforementioned tool, and that a different rotary indexer 172 may be used.

Figure 8:
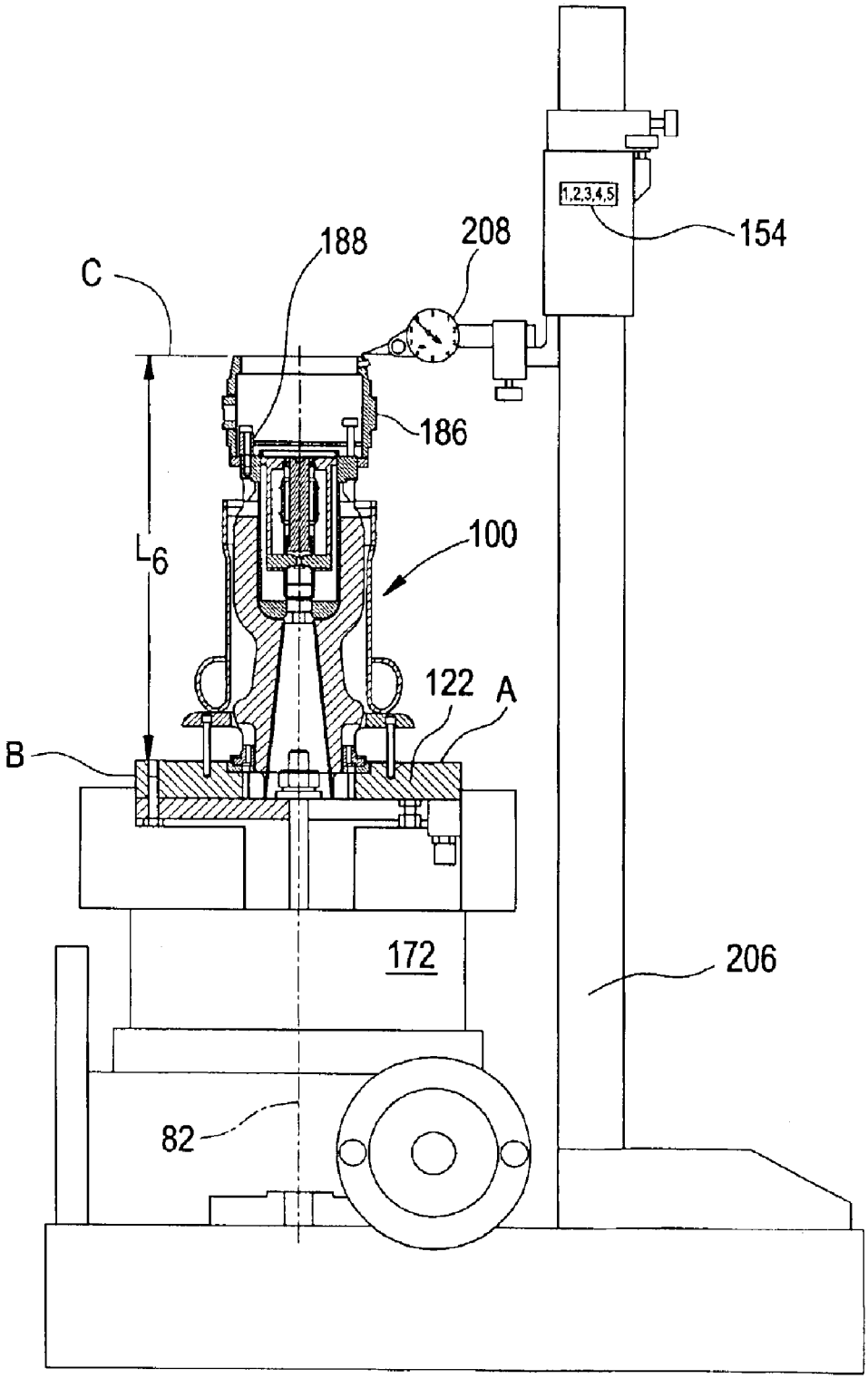
FIG. 8 illustrates how the receptacle assembly is used to establish an electron beam axis with the aid of the rotary indexer in accordance with an embodiment of the present invention.

FIG. 8 illustrates how the receptacle assembly 100 is used to establish the electron beam axis 82 with the aid of the rotary indexer 172. FIGS. 7 and 8 will be discussed together. The receptacle assembly 100 is mounted on the rotary indexer 172 via the receptacle mounting flange 122 and by way of, for example, a hold-down bar 176, two or more screws 178, alignment post 180 and leveling jaw 182.

Primary datum A for the electron source assembly 150 is based upon the surface of the receptacle mounting flange 122 and establishes a transverse or lateral plane (X-Y plane). Secondary datum B for the electron source assembly 150 is based upon the outside diameter of the receptacle mounting flange 122. The electron beam axis 82 is established from the receptacle mounting flange 122 of the receptacle assembly 100 using datum surfaces A and B, and is perpendicular to the X-Y plane. The receptacle assembly 100 is rotated 360 degrees and the Full Indicator Movement (FIM) of dial indicators 174 and 175 are noted.

The FIM is the absolute sum of the largest positive and largest negative movement of the dial indicator hand. For example, angular FIM is a dial indicator reading measuring how far a surface is out of parallel with datum A. The lateral, or X-Y, FIM is a dial indicator reading measuring how far the axis of a part is from the desired axis, such as electron beam axis 82.

Datum A is adjusted to be perpendicular to the rotational axis of the rotary indexer 172 by use of dial indicator 175. Three jack screws 184 (one is shown) are used to reduce the FIM to a predefined value. Dial indicator 174 is used to verify that the secondary datum B is concentric to the rotational axis of the rotary indexer 172.

The ring-shaped ground electrode 168 is mounted to the receptacle mounting flange 122 using screws 170 screwed into threaded holes 78. Two screws 170 are illustrated, however four screws 170 are used and may be spaced equidistant around the circumference of the ground electrode 168. The field electrode 161 is illustrated in two positions in FIG. 7. Position 1 illustrates the field electrode 161 resting on the ground electrode 168, and position 2 illustrates the field electrode 161 mounted to the adapter 186 as discussed below.

Three levelers 188 (one is shown) are installed and spaced equidistant in the adapter 186. Optionally, more than three levelers 188 may be used. The adapter 186 is then installed on the receptacle assembly 100 by inserting screws 189 through the levelers 188 and into the threaded holes 116 (FIG. 3) in the electrically common shell 104. The levelers 188 serve the dual purposes of moving the adapter 186 axially (along electron beam axis 82) and establishing its correct angular orientation with respect to datum A. The axial dimension $L_6$ is achieved by adjusting the levelers 188 and measuring from the datum A to the edge of the adapter 186 (line C) with a height gage 206, such as at height reading 154. The angular FIM is achieved by spinning the rotary indexer 172 and adjusting the levelers 188 until the desired FIM is achieved at dial indicator 208.

Set screws 190 are located at four places equidistance around the circumference of the electrically common shell 104 and push laterally on the adapter 186. It should be understood that more or less set screws 190 may be used, such as 3 or 5 set screws 190. The set screws 190 are adjusted and the rotary indexer 172 is spun in a repeated pattern until the desired lateral FIM is achieved at dial indicator 173. It should be understood that the axial, lateral, and angular adjustments discussed above are interrelated. Therefore, the levelers 188 and set screws 190 may be iteratively adjusted until the desired FIM tolerances are achieved. Once the adapter 186 is adjusted, jack screws 192 and screws 189 are tightened to fasten the levelers 188 at the adjusted position, and the field electrode 161 is moved to position 2 and fastened to the adapter 186.

Figure 9:
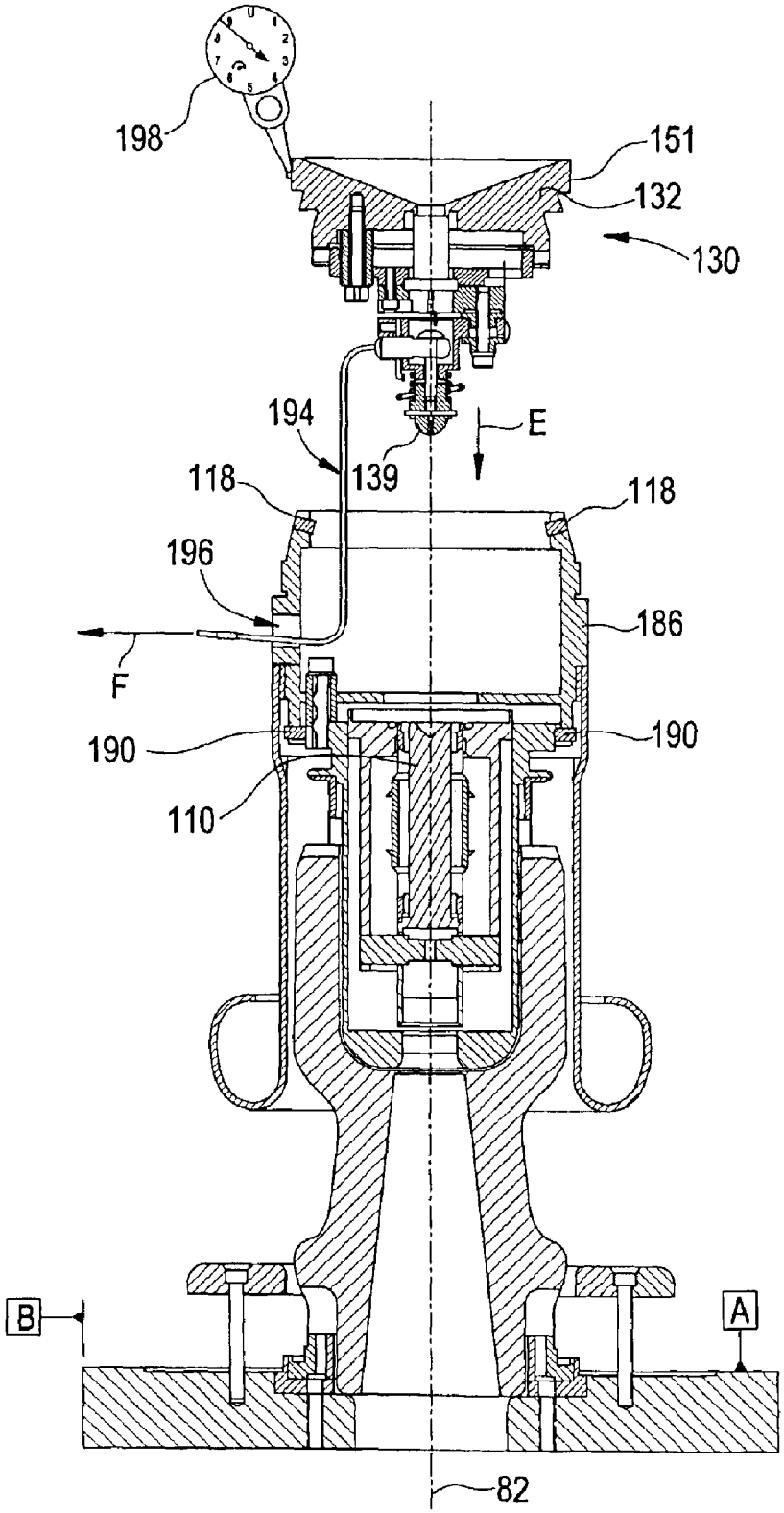
FIG. 9 illustrates the preassembled cathode focus assembly being installed into the adapter and receptacle assembly of FIG. 7 in accordance with an embodiment of the present invention.

FIG. 9 illustrates the preassembled cathode-focus electrode assembly 130 being installed into the adapter 186 and receptacle assembly 100 of FIG. 7. There are four set screws 118 spaced equidistant around the rim of the adapter 186. To prevent the cathode contact 139 from interfering when centering the cathode-focus electrode assembly 130, a release cable 194 may be utilized to hold the cathode contact 139 away from the rod 110. The release cable 194 is threaded through a hole 196 in adapter 186.

The cathode-focus electrode assembly 130 is then lowered into the adapter 186 in the direction of arrow E. The set screws 118 are adjusted to align the focus electrode 132 to achieve a desired lateral FIM tolerance with indicator 198. The cathode contact 139 is released by pulling the release cable 194 in the direction of arrow F.

Returning to FIG. 6, the field electrode 160 may then be installed by sliding the field electrode 160 over the cathode-focus electrode assembly 130. The flange 156 is mounted to the receptacle mounting flange 122. One end of the tube 70 is mounted to flange 156, and the flange 74 is mounted to the other end of the tube 70. The anode assembly 90 may now be inserted and aligned with respect to the datums A and B.

Figure 10:
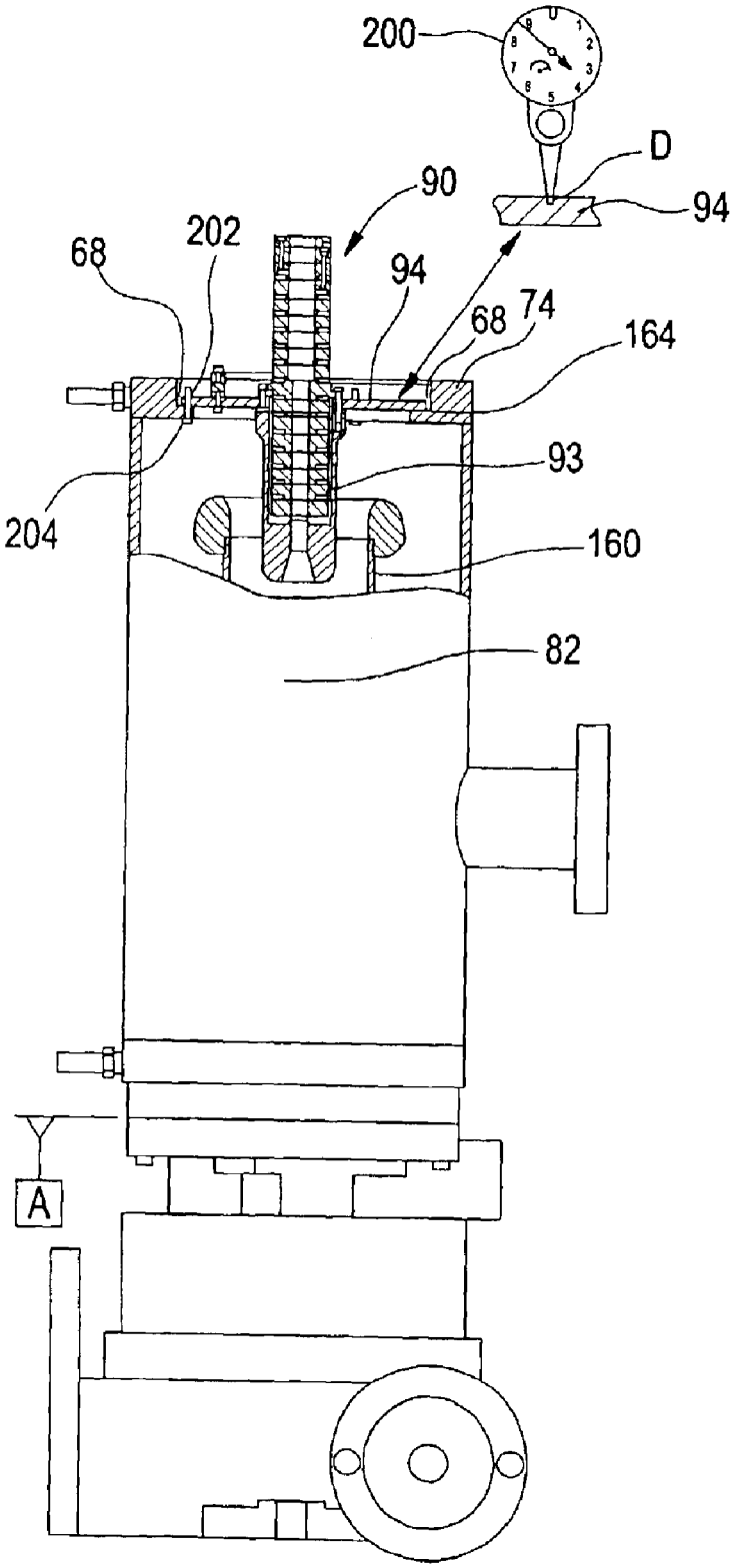
FIG. 10 illustrates a cutaway view of the anode assembly mounted to the plate 94 in accordance with an embodiment of the present invention.

FIG. 10 illustrates a cutaway view of the anode assembly 90 mounted on the plate 94. The anode assembly 90 is installed on mounting surface 164 of flange 74. The axial position of the anode assembly 90 has been predetermined by the measured dimensions $L_1$, $L_2$, $L_3$ and $L_5$ and the calculated dimension $L_6$. The angular orientation of the anode assembly 90 is established by the parallelism requirement of the mounting surface 164 of the flange 74. The anode assembly 90 is moved within gap 68 and is aligned in the lateral plane by measuring the lateral FIM of an alignment groove D in mounting plate 94 with dial indicator 200. When the predefined lateral FIM is achieved a nut 202 is tightened on the screw 204 (three or more places) to secure the anode assembly 90 in place.

As illustrated in FIGS. 3–10, the electron source assembly 150 is an oil-free assembly designed to minimize the coupling between the five degrees of freedom. Therefore, the alignment of the electron source assembly 150 is easier and quicker compared to previous electron sources, allowing faster assembly and refurbishment of the electron source assembly 150. In addition, by prealigning the cathode-focus electrode assembly 130, the replacement of the cathode 149 in the electron source assembly 150 requires less time and expense compared to previous electron sources.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electron source, comprising:

a vacuum chamber maintaining a vacuum therein, said vacuum chamber having a flange at one end and an anode mounting surface at an opposite end, said vacuum chamber having an electron beam axis extending through said vacuum chamber;

an insulated receptacle having a receptacle mounting flange secured to said flange, said receptacle mounting flange having a receptacle surface establishing a lateral plane perpendicular to said electron beam axis;

an anode provided within said vacuum chamber, said anode having an anode surface exposed to said vacuum;

a cathode provided within said vacuum chamber, said cathode having an emitter with an emitter surface exposed to said vacuum, said anode and cathode being aligned with one another along said electron beam axis;

an adapter mounted to said receptacle within said vacuum chamber, said adapter retaining said cathode at a predetermined orientation and position with respect to said electron beam axis; and adjustment members mounted to said adapter, said adjustment members being distributed to move said adapter in five degrees of freedom with respect to said electron beam axis and said lateral plane.

2. The electron source of claim 1, further comprising adjustment members shifting said cathode within said lateral plane with respect to said electron beam axis.

3. The electron source of claim 1, said receptacle mounting flange having an outside diameter, said electron beam axis being established based on said outside diameter.

4. The electron source of claim 1, said adjustment members shifting said adapter along said electron beam axis toward and away from said anode surface.

5. The electron source of claim 1, said adjustment members adjusting an angular orientation of said adapter with respect to said electron beam axis.

6. The electron source of claim 1, further comprising a focus electrode having a side edge and being mounted to said cathode, said focus electrode being configured to interface with said adapter, said cathode being adjustable laterally with respect to said side edge.

7. The electron source of claim 1, further comprising a focus electrode having an outer edge and being mounted to said cathode, said focus electrode having at least three levelers mounted therein, said at least three levelers adjusting a distance between said outer edge and said emitter surface.

8. The electron source of claim 1, further comprising a focus electrode being mounted to said cathode, said cathode being adjustable laterally with respect to a side edge of said emitter.

9. The electron source of claim 1, further comprising screws mounted to said adapter, said screws providing a secondary locking mechanism to secure said adapter to said receptacle in an aligned position.

* * * * *

UNITED STATES PATENT AND TRADEMARK OFFICE

CERTIFICATE OF CORRECTION

PATENT NO. : 6,891,321 B2
DATED : May 10, 2005
INVENTOR(S) : Sanders et al.

It is certified that error appears in the above-identified patent and that said Letters Patent is hereby corrected as shown below:

Column 1,
Line 16, delete "Provisional".
Line 16, delete "60/426,088" and substitute therefore -- 10/308,981 --

Signed and Sealed this

Ninth Day of August, 2005

JON W. DUDAS
*Director of the United States Patent and Trademark Office*